US011197533B2

(12) United States Patent
Sirichai

(10) Patent No.: US 11,197,533 B2
(45) Date of Patent: Dec. 14, 2021

(54) UNIVERSAL ARMBAND ASSEMBLY WITH RESILIENT DEVICE-RETAINER

(71) Applicant: World Richman Manufacturing Corporation, Elgin, IL (US)

(72) Inventor: Saharut Sirichai, Bangkok (TH)

(73) Assignee: World Richman Manufacturing Company, Elgin, IL (US)

( * ) Notice: Subject to any disclaimer, the term of this patent is extended or adjusted under 35 U.S.C. 154(b) by 0 days.

(21) Appl. No.: 17/090,781

(22) Filed: Nov. 5, 2020

(65) Prior Publication Data

US 2021/0127816 A1 May 6, 2021

Related U.S. Application Data

(60) Provisional application No. 62/931,315, filed on Nov. 6, 2019.

(51) Int. Cl.
*A45F 5/00* (2006.01)

(52) U.S. Cl.
CPC ..... *A45F 5/00* (2013.01); *A45F 2005/008* (2013.01); *A45F 2200/0516* (2013.01); *A45F 2200/0525* (2013.01)

(58) Field of Classification Search
CPC ..... A45F 2005/008; A45F 2200/0516; A45F 2200/008; A45F 2200/0525; A45F 5/02; A45F 5/00; Y10S 224/93
USPC ..... 224/219, 222
See application file for complete search history.

(56) References Cited

U.S. PATENT DOCUMENTS

2013/0026324 A1* 1/2013 Fischer ..... F16M 11/041 248/316.1
2013/0213838 A1* 8/2013 Tsai ..... G06F 1/1628 206/320
2016/0183667 A1* 6/2016 MacColl ..... A45F 5/00 224/222

* cited by examiner

*Primary Examiner* — Adam J Waggenspack
(74) *Attorney, Agent, or Firm* — Christopher J. Scott

(57) ABSTRACT

A universal armband assembly retains a cuboidal, electronic device in adjacency to a user's arm, and includes an armband and a resilient device-retainer formation. The armband includes a band-to-retainer interface portion and a strap portion. The band-to-retainer interface portion includes a strap-letting aperture and an outer interface portion end. The strap portion extends from the band-to-retainer interface portion in a direction opposite the outer interface portion end. The device-retainer formation is formed from a resilient unibody material construction, is attached to the band-to-retainer interface portion, and is configured to define a relaxed interior volume when in a relaxed state. The device-retainer formation is actuable to define an actuated interior volume, which interior volume receives the electronic device. Restorative forces of the resilient unibody material retain the electronic device within the actuated interior volume. Together the armband and device-retainer formation retain the electronic device in adjacency to the user's arm.

11 Claims, 10 Drawing Sheets

UNIVERSAL ARMBAND ASSEMBLY WITH RESILIENT DEVICE-RETAINER

PRIOR HISTORY

This application claims the benefit of U.S. Provisional Patent Application No. 62/931,315 filed in the United States Patent and Trademark Office on 6 Nov. 2019, the specifications and drawings of which are hereby incorporated by reference.

FIELD OF THE INVENTION

The present invention relates generally to a universal armband assembly for use with a mobile or electronic communications device. The present invention more particularly relates to a universal armband assembly for use with variously sized mobile or electronic communications devices for retaining the mobile or electronic communications devices of various sizes, but generally of a rectangular cuboidal form in adjacency to the user's person and specifically the user's arm.

SUMMARY OF THE INVENTION

Among the primary objectives of the present invention is the provision of a device-retaining armband assembly for carrying, holding, or retaining mobile communications devices exemplified by smart phones and other similarly shaped articles or devices though variously sized and dimensioned and preferably of a general cuboidal shape. In this regard, the armband assembly according to the present invention provides a uniquely formed or configured resilient device-retention formation or device-retainer, which formation is attached to a strap-like armband. The strap-like armband primarily functions as an interface mechanism to encircle a user's arm or similar other support structure and is attached to the device-retention formation or device-retainer for retaining the device-retention formation in adjacency to the user's person generally and arm particularly or a similar other support structure. Together the resilient device-retention formation or device-retainer and the strap-like armband enable the user to carry/hold a mobile communications or similarly shaped other electronic device on his or her person by way of arm attachment.

The resilient device-holding formation or device-retainer is preferably formed of a resilient, elastic material exemplified by silicone or similar other rubber-like material and may thus be actuated to resiliently retain variously dimensioned mobile communications devices, typically formed to be rectangular in first and second dimensions and having a certain depth in a third dimension (i.e. rectangularly cuboid). The resilient device-retention formation or device-retainer defines a relaxed interior, truncated volumetric cuboidal space and may be actuated to define an actuated interior, truncated volumetric cuboidal space for receiving a mobile communications device defining a volume of at least the relaxed interior, truncated volumetric cuboidal space and substantially coinciding with the actuated interior, truncated volumetric cuboidal space excepting for corners of the device which extend through truncated portions of the device-retention formation or device-retainer.

In this last regard, the resilient device-retention formation or device-retainer further comprises a series of corner-engaging/retaining formations essentially defining corner harnesses for each corner of the mobile communications device. The series of corner retention formations or corner harnesses include a pair of upper formation members or harnesses and a pair of lower formation members or harnesses on opposite sides of a transverse plane. The opposing corner harnesses may be actuated in a general direction away from the transverse plane so as to be resiliently actuated for engaging and harnessing the four corners of a mobile communications device for resiliently retaining the mobile communications device within the actuated interior, truncated volumetric cuboidal space as defined once the series of corner-engaging/retaining members or harnesses and the device-retainer are resiliently actuated to receive the device.

The resilient device-holding formation or device-retainer may be provided in several different embodiments for carrying/holding variously dimensioned devices. The series of corner-engaging/retaining members or corner harnesses may each preferably provide a pair of corner-holding projections or U-shaped portions defining a corner plane that extends obliquely relative to top, bottom, and laterally opposed planes such that the corner planes and top, bottom, and laterally opposed planes define an eight-sided or octagonal arrangement. The corner planes are preferably angled at 45 degrees relative to the parallel top and bottom planes, and parallel laterally opposed planes.

Projection-interconnecting cross-members interconnect the corner-holding projections or U-shaped members associated with the pair of upper members and the pair of lower members for engaging the anterior surface of the mobile communications device as received in the resilient device-holding formation or device-retainer. The resilient device-holding formation or device retainer is preferably of a unibody construction with a posterior (solid) planar portion that interconnects the pair of upper members and the pair of lower members, which posterior planar portion is attached to the strap-like armband. The strap-like armband is adjustable for adjusting to arms or similar other support structures of varying girths.

BRIEF DESCRIPTIONS OF THE DRAWINGS

Other features and objectives of the invention will become more evident from a consideration of the following brief descriptions of patent drawings.

DETAILED DESCRIPTION OF THE PREFERRED EMBODIMENT

Figure 1:
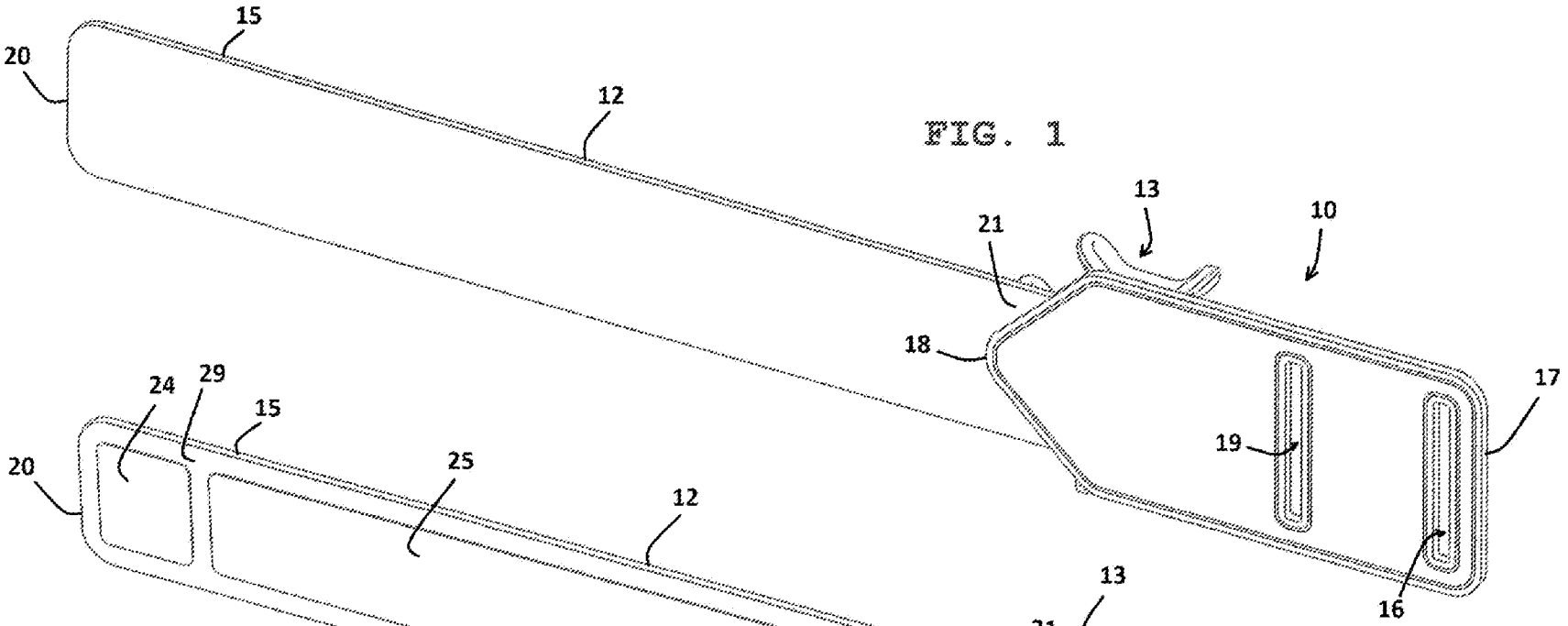
FIG. 1 is a bottom edge, posterior perspective view of a first alternative universal armband assembly according to the present invention.
Figure 2:
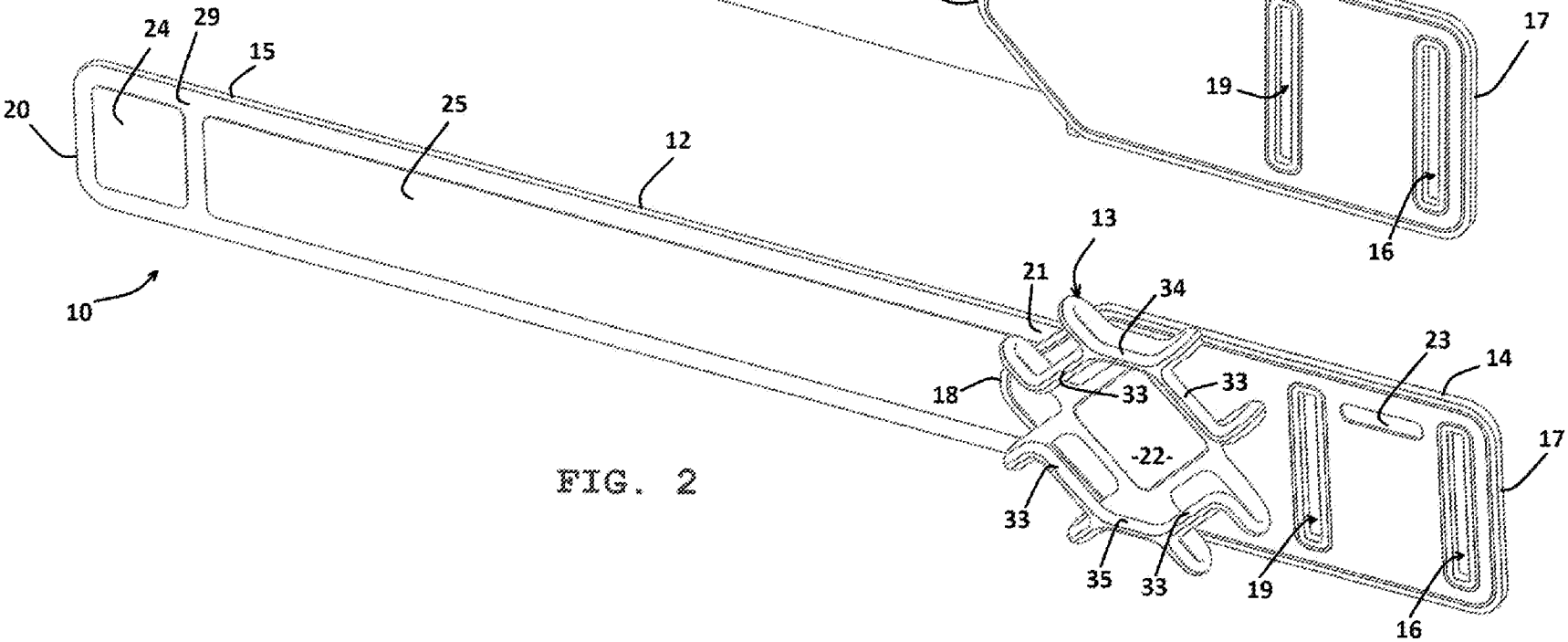
FIG. 2 is a top edge, anterior perspective view of the first alternative universal armband assembly according to the present invention.
Figure 3:
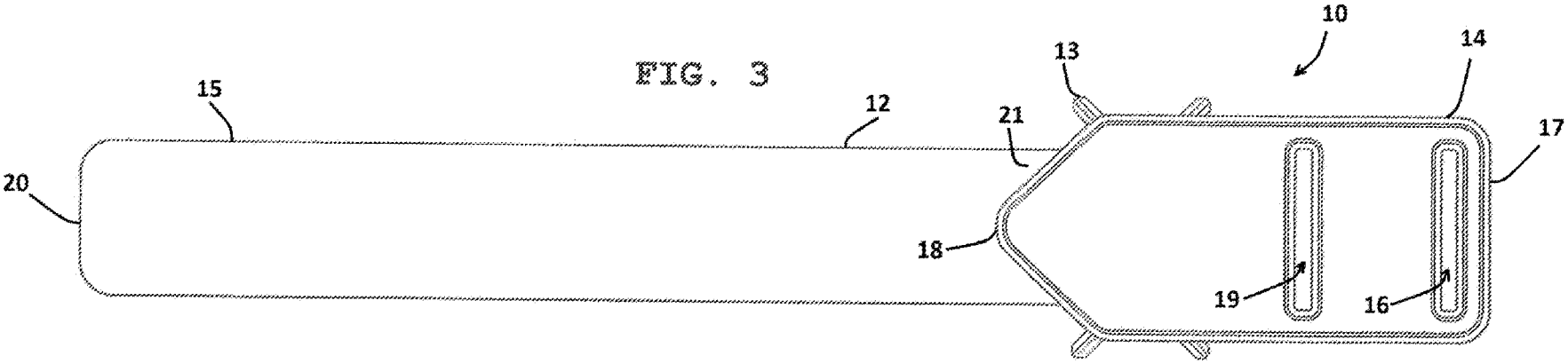
FIG. 3 is a posterior plan view of the first alternative universal armband assembly according to the present invention.
Figure 4:
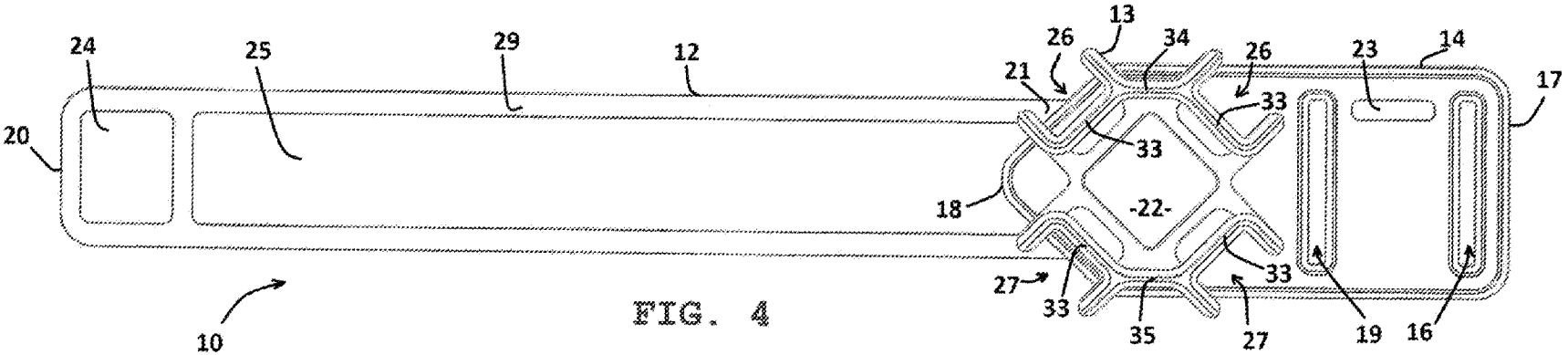
FIG. 4 is an anterior plan view of the first alternative universal armband assembly according to the present invention.
Figure 5:
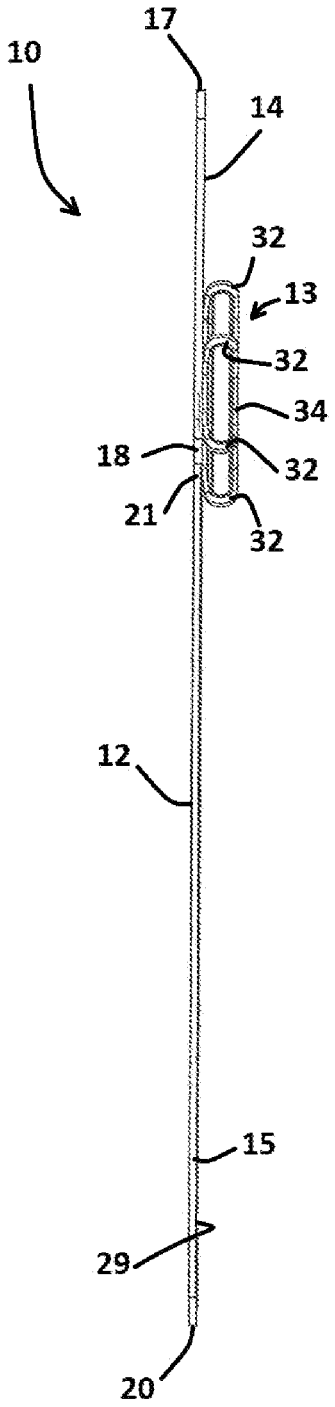
FIG. 5 is a top edge view of the first alternative universal armband assembly according to the present invention.
Figure 6:
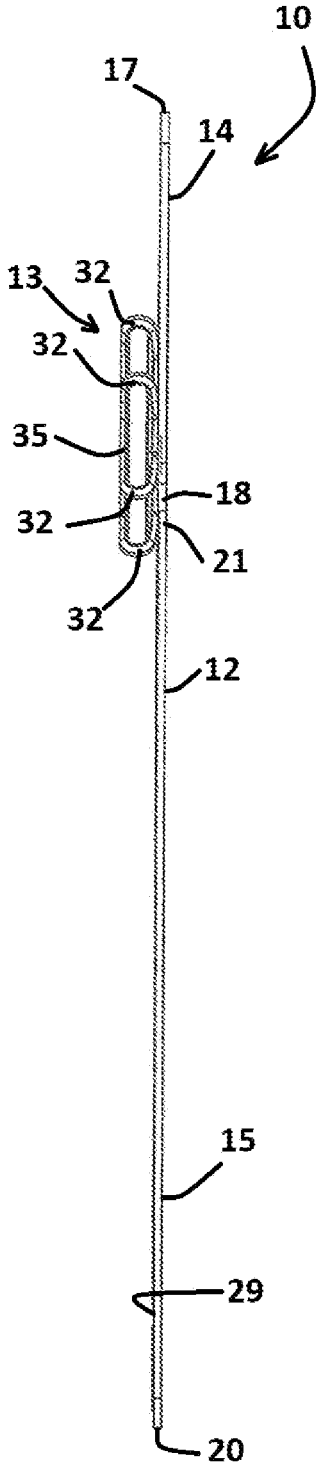
FIG. 6 is a bottom edge view of the first alternative universal armband assembly according to the present invention.

Referring now to the drawings with more specificity, the present invention preferably provides a universal armband assembly as at 10 and 10' for retaining a mobile communications device as at 11 in adjacency to a user's arm (not specifically illustrated). The universal armband assemblies 10/10' according to the present invention preferably comprise a retainer-to-support interface mechanism preferably exemplified by an armband as at 12, and a resilient device-retainer formation as comparatively referenced at 13 and 13'. The primary difference between universal armband assembly 10 and universal armband assembly 10' is the slight structural difference in the resilient device-retainer formation 13 versus resilient device-retainer formation 13', the latter resilient device-retainer formation 13' being relatively more elongate in overall configuration as compared to the former resilient device-retainer formation 13 as is discussed in more detail later below in these specifications.

The details of the armband 12 are substantially the same for both universal arm assemblies 10 and 10' and in this regard, preferably comprise a band-to-retainer interface portion as at 14 and a strap portion as at 15. The band-to-retainer interface portion 13 preferably comprises a first strap-letting aperture as at 16, an outer interface portion end 17, and an inner interface portion end as at 18. The first strap-letting aperture 16 is preferably formed adjacent the outer interface portion end 17. The first strap-letting aperture 16 preferably extends widthwise across the band-to-interface portion 14 in parallel relation relative to the substantially linear outer interface portion end 17.

A second strap-letting aperture 19 may further be preferably formed in the band-to-interface portion 14 such that the second strap-letting aperture 19 extends in parallel relation to the first strap-letting aperture 16 intermediate the first strap-letting aperture 16 and the device-retainer formations 13/13'. The strap portion 15 extends from the band-to-retainer interface portion 14 in a direction opposite the outer interface portion end 17 and comprises an outer strap portion end 20 and an inner strap portion end 21. The inner strap portion end 21 is attached to the inner interface portion end 18.

The band-to-interface portion 13 may further preferably comprise a pocket construction as at 23 intermediate the first strap-letting aperture 16 and the second strap-letting aperture 19. The pocket construction 23 enables the user to pocket-carry articles therein. Further, the outer strap portion end 20 may be preferably outfitted with a first fastener mechanism as at 24 upon an anterior surface 29 of the strap portion 15. The anterior surface 29 of the strap portion 15 intermediate the outer strap portion end 20 and the inner strap portion end 18 may preferably be further outfitted with a second fastener mechanism as at 25. The first and second fastener mechanisms 24 and 25 may be exemplified by Velcro brand hook and look type fasteners. The first and second fastener mechanisms 24 and 25 are preferably matable for removably and adjustably fastening the strap portion 15 to itself about a user's arm or similar other support structure via at least a select strap-letting aperture as selected from the group consisting of the first and second strap-letting apertures 16 and 19.

The device-retainer formations 13/13' are preferably formed from a resilient, elastic unibody material construction such as molded silicone or similar rubber-like material having elastic or resilient characteristics such that when actuated from a relaxed state, restorative forces within the resilient, elastic material operate to direct, restore, or return actuated material deformations back toward the relaxed configuration. The resilient unibody device-retainer formations 13/13' are attached to the band-to-retainer interface portion 14 via the planar posterior attachment portion 22. The resilient device-retainer formations 13/13' are configured to define a relaxed, truncated cuboidal interior volume or space when in a relaxed configuration as generally depicted in FIGS. 1-7 and 9-17.

Figure 7:
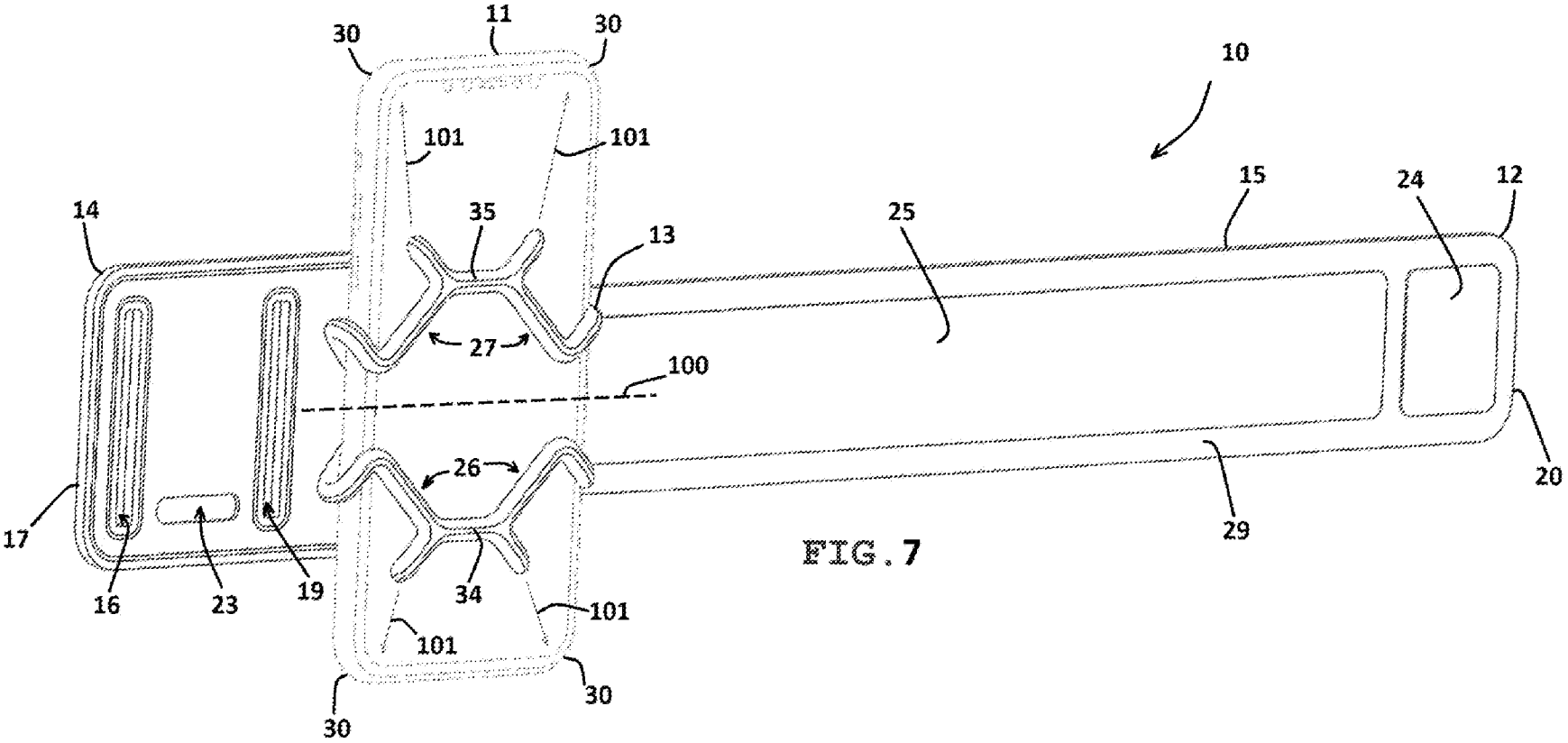
FIG. 7 is a bottom edge, anterior perspective view of the first alternative universal armband assembly according to the present invention depicting a phantom mobile communications device positioned for retention by a first device-retainer formation of the first alternative universal armband assembly.
Figure 8:
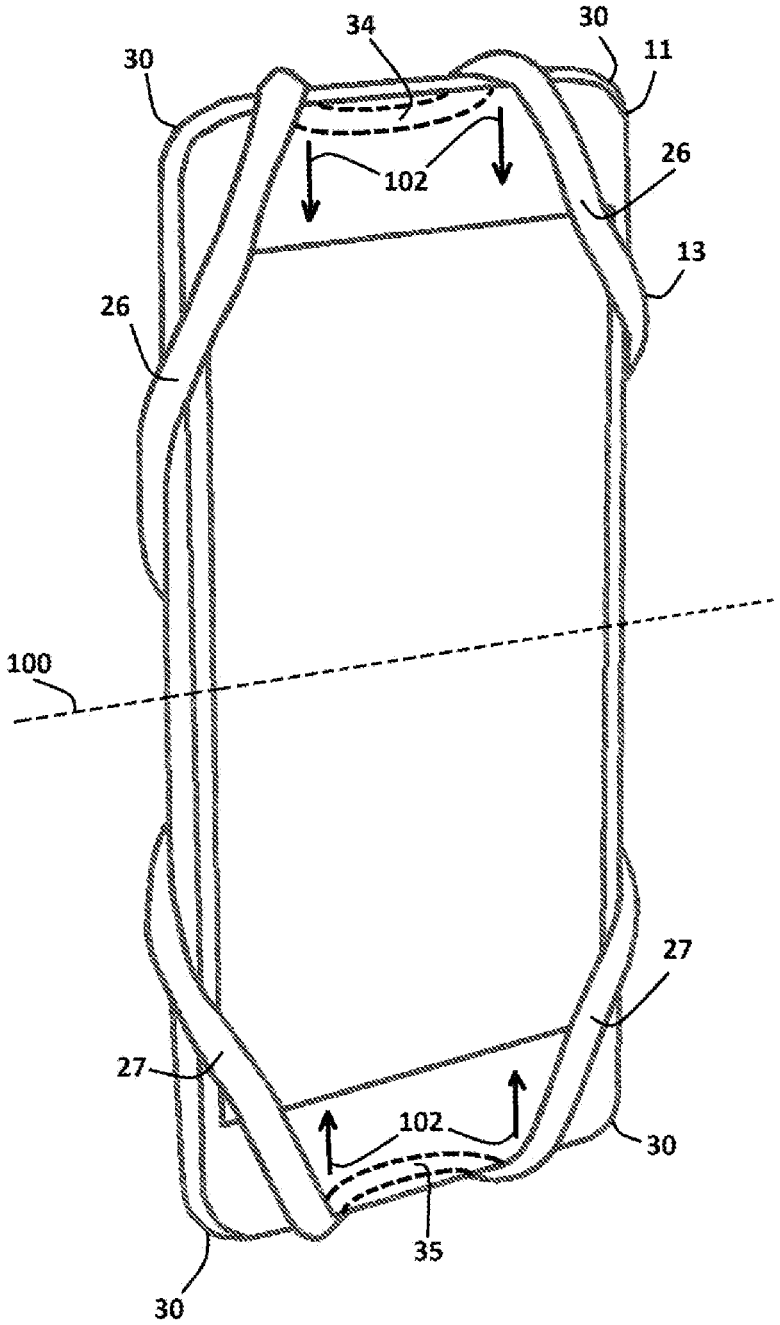
FIG. 8 is an enlarged anterior perspective view of a generic mobile communications device depicted as resiliently retained by a generic device-retainer formation according to the present invention.
Figure 10:
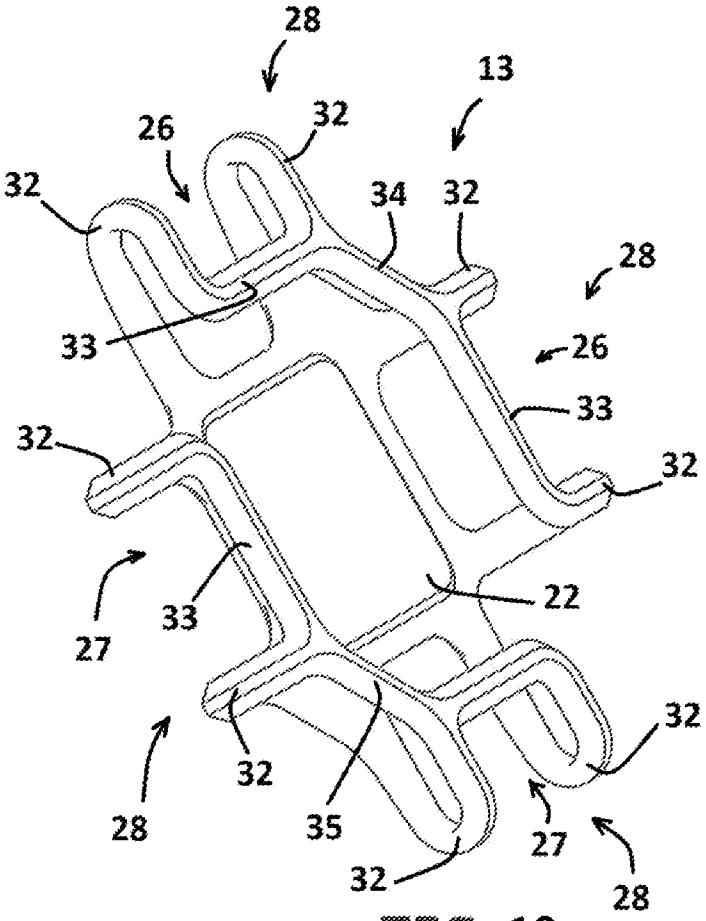
FIG. 10 is a bottom anterior perspective view of the first device-retainer formation according to the present invention.
Figure 9:
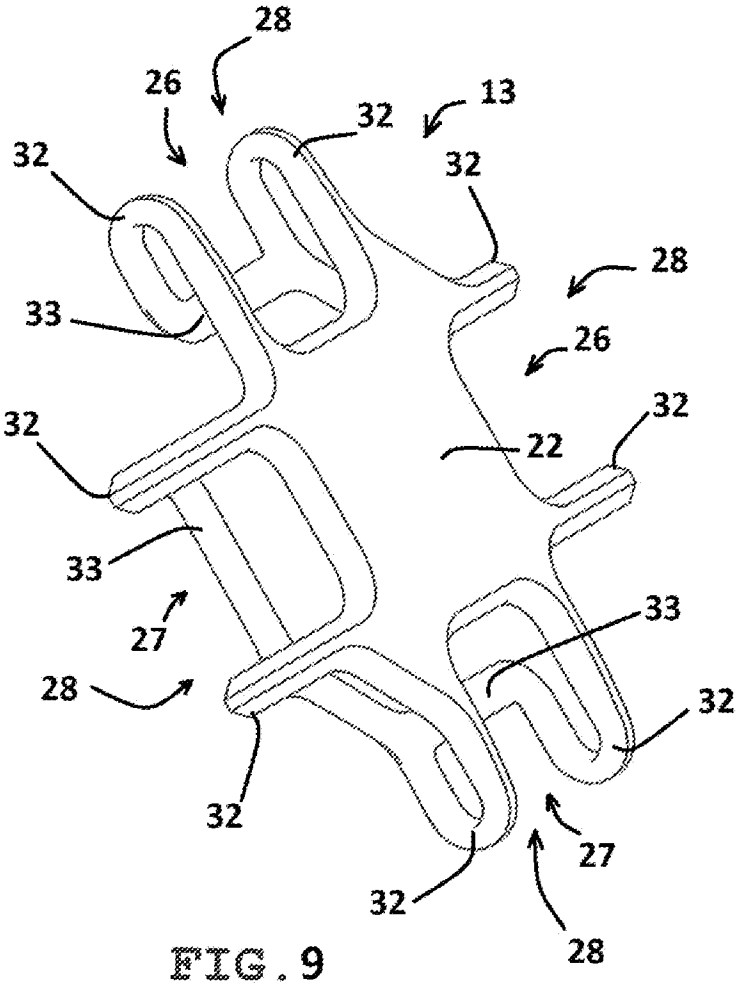
FIG. 9 is a bottom posterior perspective view of the first device-retainer formation according to the present invention.

Referencing FIG. 7, the reader will there note vectors/arrows 101 representing directional actuation of the device-retainer formation 13. FIG. 8 depicts a generic resilient device-retainer formation in an actuated, device-retaining configuration. Comparatively referencing FIG. 7 versus FIG. 8, the reader will further consider the restorative or return forces as at 102 returning the resilient, elastic unibody material construction of the generic device-retainer formation back toward the relaxed configuration, the elastic deformation of which operates to retain the mobile communications device 11 within the device-retainer formations 13/13' as generically depicted in FIG. 8.

Referencing the return force depictions as at 102 returning or restoring the generic device-retainer formation to its relaxed state or configuration, the reader will further consider the device-retainer formations 13/13' are actuable from the relaxed configuration to define an actuated, truncated cuboidal interior volume or space, which actuated, truncated cuboidal interior volume or space receives a cuboidal mobile communications device 11 typified by a smart phone, tablet or similar other personal communications device 11. The corners 30 of the received device 11 extend past the truncated portions or facets 31 of the device-retainer formations 13/13'. In other words, the corners 30 extend into phantom vertices at the truncated portions/facets 31. Restorative forces as at 102 inherent to the resilient, elastic unibody material construction thereby operate to retain a received cuboidal mobile communications device 11 within the actuated, truncated cuboidal interior volume of the device-retainer formations 13/13'.

Figure 12:
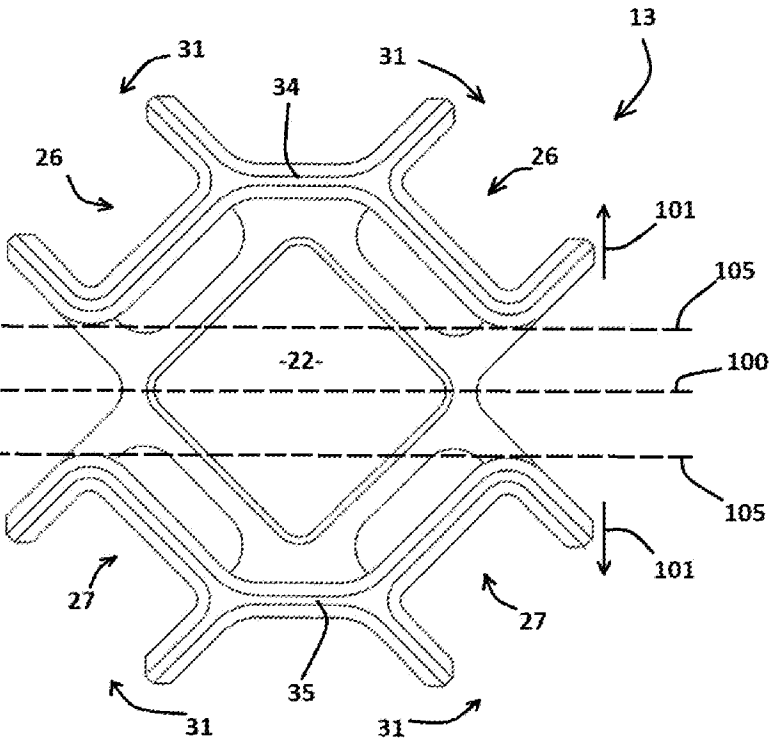
FIG. 12 is an anterior plan view of the first device-retainer formation according to the present invention.
Figure 11:
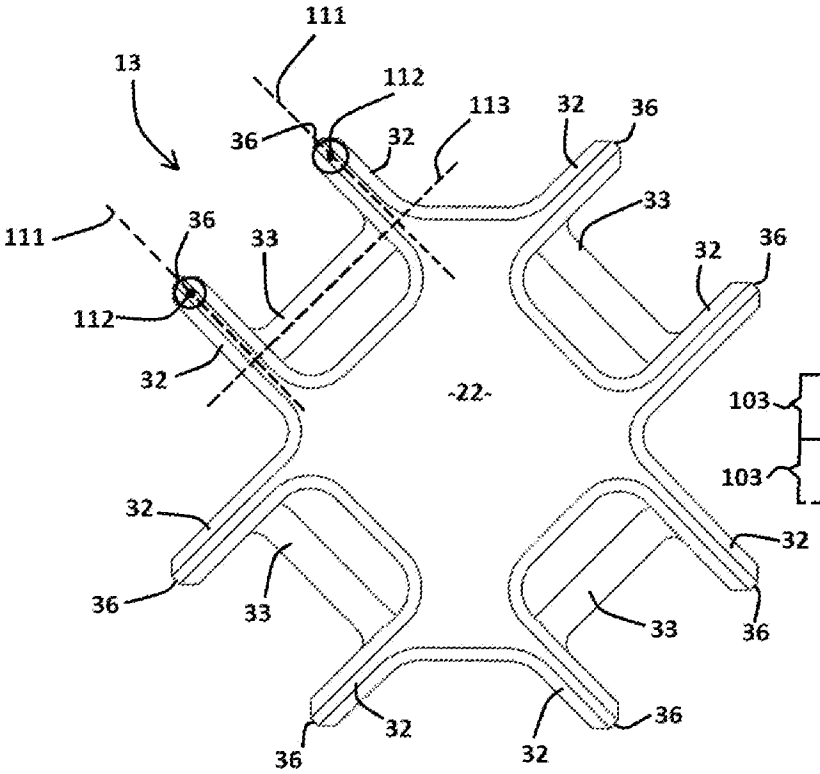
FIG. 11 is a posterior plan view of the first device-retainer formation according to the present invention.
Figures 11A, 12A:
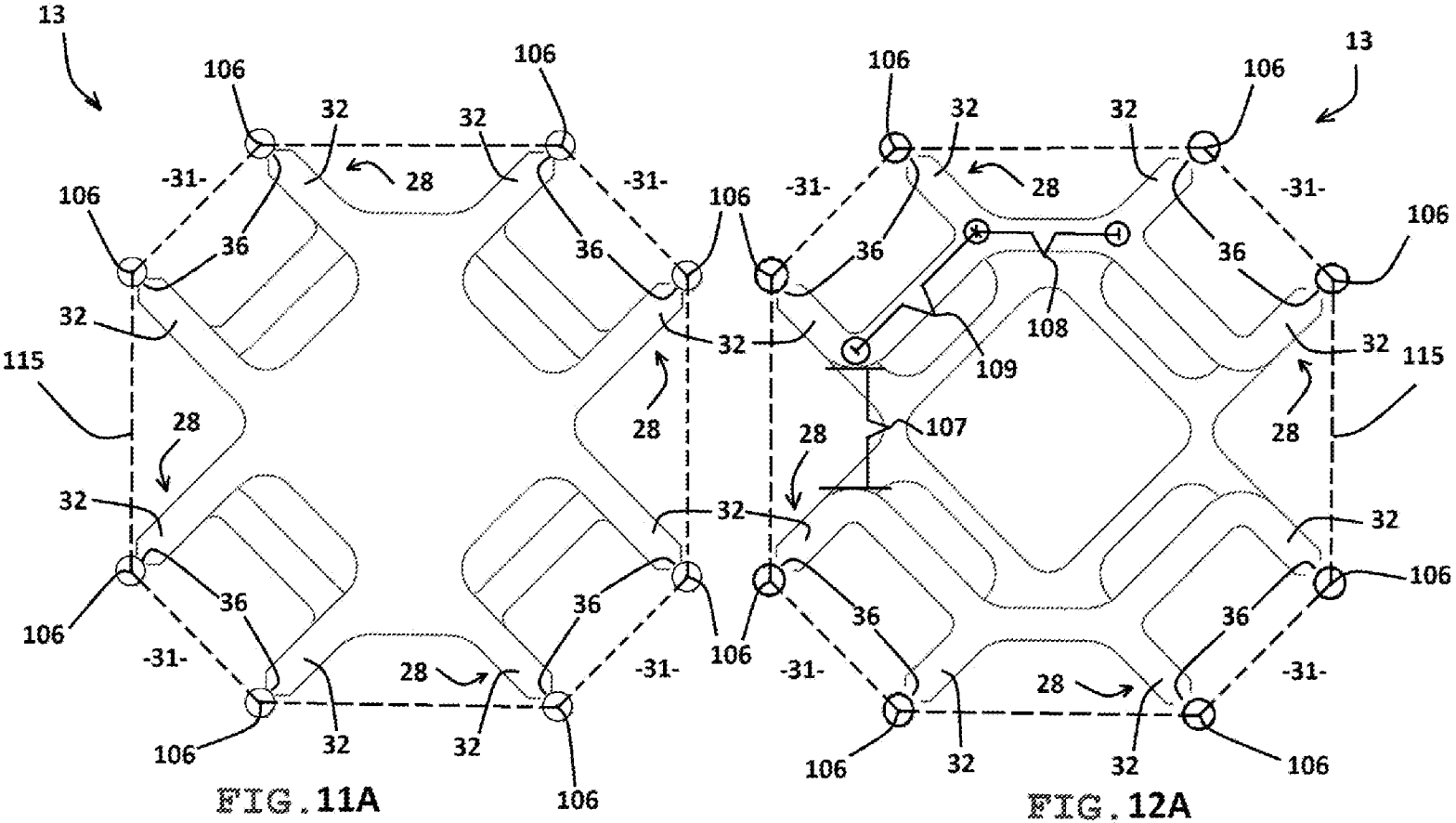
FIG. 11A is a posterior phantom plan view of the first device-retainer formation according to the present invention in a relaxed configuration to depict the regular octagonal form of the first device-retainer formation when in the relaxed configuration.
FIG. 12A is an anterior phantom plan view of the first device-retainer formation according to the present invention in the relaxed configuration to depict the regular octagonal form of the first device-retainer formation when in the relaxed configuration.
Figures 13, 14, 15, 16:
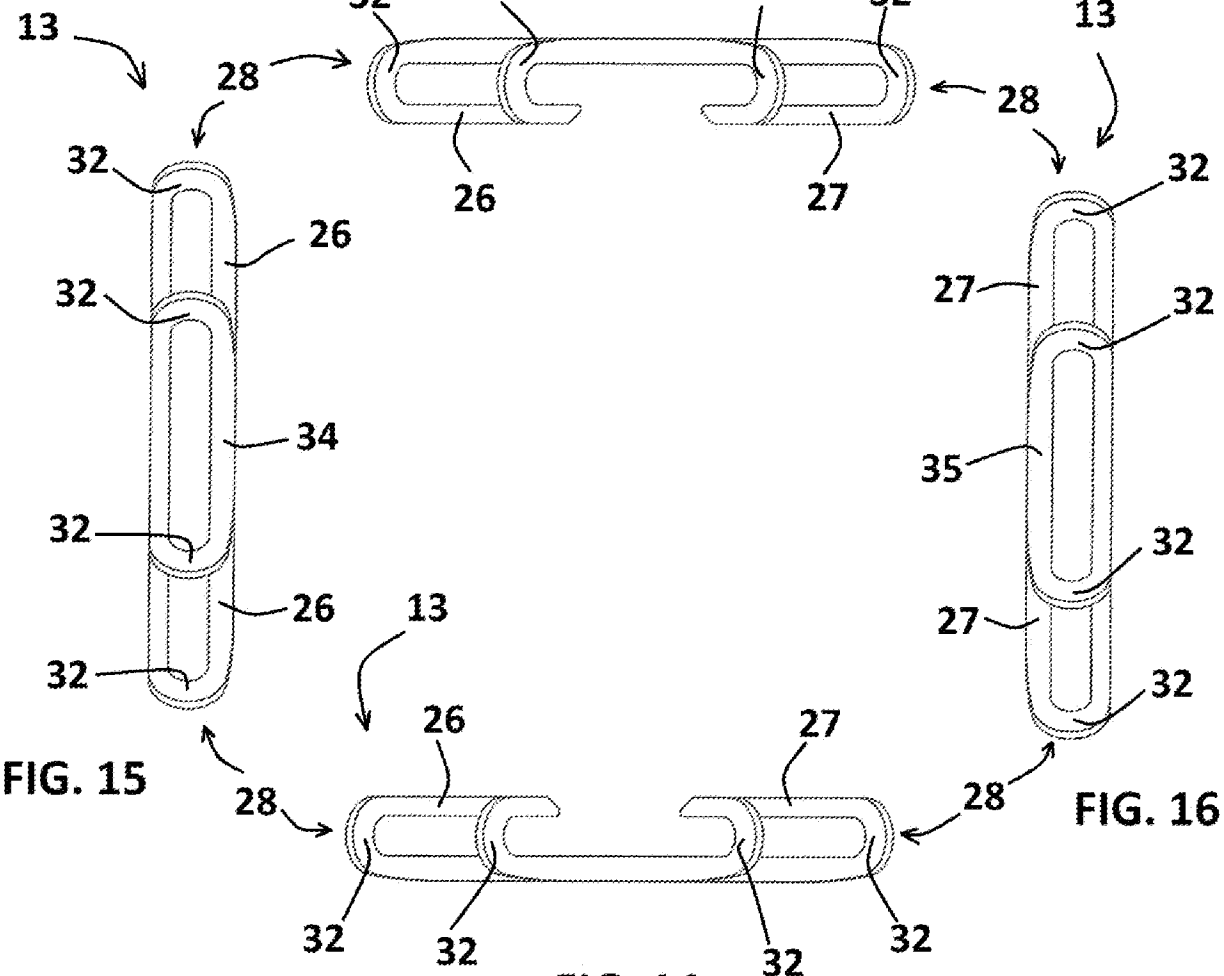
FIG. 13 is a right lateral edge view of the first device-retainer formation according to the present invention.
FIG. 14 is a left lateral edge view of the first device-retainer formation according to the present invention.
FIG. 15 is a top edge view of the first device-retainer formation according to the present invention.
FIG. 16 is a bottom edge view of the first device-retainer formation according to the present invention.
Figure 17:
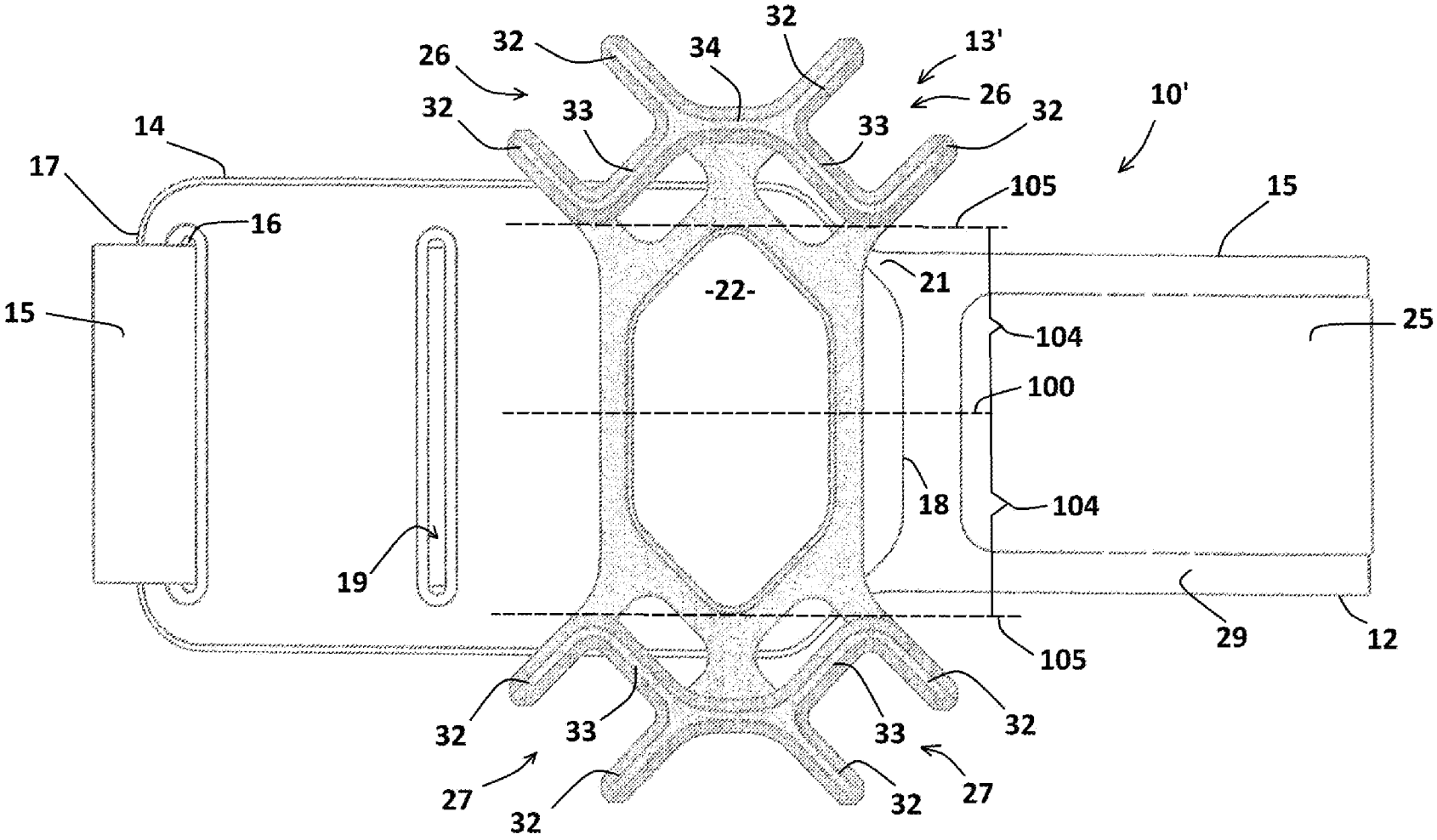
FIG. 17 is an anterior plan view of a second alternative universal armband assembly according to the present invention highlighting a relatively elongate second device-retainer formation as compared to the first device-retainer formation.

The device-retainer formation 13 may be characterized by having a substantially regular octagonal or truncated square form in plan view as generally and comparatively depicted in FIGS. 11 and 12, and as further more particularly depicted in FIGS. 11A and 12A. The device-retainer formation 13' may be characterized by having an oblong, truncated rectangular form in plan view as generally depicted in FIG. 17. Lines 106 extending into/out of the page in FIGS. 11A and 12A tangent to the arched tips 36 of the U-shaped portions 32 of each corner-retention harness 28 define vertices of the device-retainer formations 13/13' and when interconnected further define octagonal forms as at 115 in plan view. The reader will note the series of corner-receiving truncations or truncated portions as at 31. The corner-receiving truncations or truncated portions 31 receive the series of corners 30 of the mobile communications device 11.

It is contemplated that the device-retainer formation 13 is designed to receive and retain mobile communications devices 11 having a relatively shorter overall length whereas the device-retainer formation 13' is designed to receive and retain mobile communications devices 11 having a relatively longer overall length. Differently configured device-retainer formations 13/13' may thus help avoid fracture of the device-retainer formation feature by decreasing stresses caused by elastic deformations of the resilient, elastic unibody material construction.

As prefaced above, the device-retainer formations 13/13' are further characterized by preferably comprising a series of four corner-retention formations or harnesses 28. The series of corner-retention formations or harnesses 28 preferably include a pair of first or upper corner-retention harnesses as at 26 and a pair of second or lower corner-retention harnesses as at 27. The pair of first or upper corner-retention harnesses 26 extend opposite the pair of second or lower corner-retention harnesses 27 from a transverse plane as at 100, and are actuable away from the transverse plane 100 as at arrows 101 for receiving the mobile communications device 11 lengthwise between the pair of first or upper corner-retention harnesses 26 and the pair of second or lower corner-retention harnesses 27. The spatial distance 104 between the transverse plane 100 and the inner edge planes 105 of the upper and lower harnesses 26/27 is greater in the case of the device-retainer formation 13' as compared to the distance 103 between the transverse plane 100 and the inner edge planes 105 of the upper and lower harnesses 26/27 of the device-retainer formation 13.

The series of corner-retention formations or harnesses 28 each preferably comprise laterally opposed U-shaped portions as at 32 and a cross-bar portion as at 33. The U-shaped portions 32 of each respective corner-retention harness 28 preferably extend in first and second dimensions as at 111 and 112. The cross-bar portion 33 of each respective corner-retention harness 28 preferably extends in a third dimension 113 orthogonal to the first and second dimensions 111 and 112 when the device-retainer formations 13/13' are in relaxed state or configuration defining the relaxed, truncated cuboidal interior volume.

The pair of upper corner-retention harnesses 26 are preferably interconnected anteriorly by an upper cross-bar linkage as at 34 and the pair of lower corner-retention harnesses 27 are preferably interconnected anteriorly by a lower cross-bar linkage as at 35. The cross-bar portions 33 preferably extend obliquely relative to the upper and lower cross-bar linkages 34 and 35 and the transverse plane 100. Referencing FIG. 8, the reader will there consider the upper cross-bar linkage 34 and the lower cross-bar linkage 35 are preferably displaced to a posterior position relative to the mobile communications device 11 when the device-retainer formations 13/13' are actuated into the device-retaining, actuated configuration or state. The device-retainer formations 13/13' are thus preferably configured for providing upper and lower cross-bar linkage posterior displacements for enhancing stability of the mobile communications device 11 when retained within the actuated, truncated cuboidal interior volume.

Recalling that the device-retainer formation 13 is substantially regularly octagonal when in the relaxed configuration, a least linear distance as at 107 between the upper cross-bar portions 33 and the lower cross-bar portions 33 is preferably substantially equal to an upper and lower cross-bar linkage length as at 108 of each cross-bar linkage 34 and 35. Further, the upper and lower cross-bar linkage length 108 is preferably substantially equal to a cross-bar portion length 109 of each cross-bar portion 33 as generally depicted and referenced in FIG. 12A. The substantially equal elemental lengths as at 107, 108, and 109 of device-retainer formation 13 help define the substantially regular octagonal form 115 thereof when in the relaxed configuration.

The armband 12 is preferably configured to encircle the user's arm or similar other support structure for retaining the device-retainer formations 13/13' in adjacency to the user's arm. The device-retainer formations 13/13' are configured for retaining the received mobile communications device 11 in adjacency to the armband 12, and thus the universal armband assemblies 10/10' retain the mobile communications device 11 in adjacency to the user's arm for hands-free use or easy manual access as might be convenient during exercise routines, during driving activity, and similar other activities when hands-free usage of the mobile communications device 11 is preferable.

While the above descriptions contain much specificity, this specificity should not be construed as limitations on the scope of the invention, but rather as an exemplification of the invention. In certain embodiments, the basic invention may be said to essentially teach or disclose an armband assembly for retaining a cuboidal or electronic device in adjacency to a user's arm or similar other support structure. The armband assembly according to the present invention may be said to essentially comprise an armband and a device-retainer formation as variously described.

The armband essentially comprises a band-to-retainer interface portion and a strap portion. The band-to-retainer interface portion comprises an outer interface portion end, and the strap portion extends from the band-to-retainer interface portion in a direction opposite the outer interface portion end. The device-retainer formation is formed from a resilient unibody material construction. The device-retainer formation is attached to the band-to-retainer interface portion, and is configured to define a relaxed, interior volume. The device-retainer formation is further actuable to define an actuated, interior volume. The actuated, interior volume receives the cuboidal or electronic device, and restorative forces of in inherent to the resilient unibody material construction retain the electronic device within the actuated, interior volume.

The armband as an interface mechanism is configured to encircle the user's arm for retaining the device-retainer formation in adjacency to the user's arm. The device-retainer formation retains the electronic device in adjacency to the armband, and thus the armband assembly retain the cuboidal or electronic device in adjacency to the user's arm. The device-retainer formation may be preferably characterized by comprising a series of corner-retention harnesses, including a pair of upper corner-retention harnesses and a pair of lower corner-retention harnesses. The pair of upper corner-retention harnesses extend opposite the pair of lower corner-retention harnesses from or about a transverse plane, and are actuable in a direction away from the transverse plane for receiving the cuboidal or electronic device lengthwise between the pair of upper corner-retention harnesses and the pair of lower corner-retention harnesses.

The corner-retention harnesses may each be further characterized by comprising opposed U-shaped portions, and a cross-bar portion. The U-shaped portions extend in first and second dimensions, and the cross-bar portion extends in a third dimension orthogonal to the first and second dimensions when the device-retainer formation is in a relaxed configuration defining the relaxed, interior volume. The device-retainer formation may be further characterized by comprising an upper cross-bar linkage and a lower cross-bar linkage.

The upper cross-bar linkage interconnects the cross-bar portions of the pair of upper corner-retention harnesses, and the lower cross-bar linkage interconnects the cross-bar portions of the pair of lower corner-retention harnesses with the cross-bar portions extending obliquely relative to the upper and lower cross-bar linkages and the transverse plane. The upper and lower cross-bar linkages are displaced to a posterior position relative to the cuboid or electronic device when the device-retainer formation is actuated into an actuated configuration thereby providing upper and lower cross-bar linkage posterior displacements. The upper and lower cross-bar linkage displacements enhance stability of the electronic device as retained within the actuated, interior volume.

The U-shaped portions of each corner harness render the device-retainer formation octagonal in plan view thereby providing a series of corner-receiving truncations. The corner-receiving truncations receive a series of corners of the cuboidal or electronic device. In a certain embodiment, the device-retainer formation is regularly octagonal as in the case of device-retainer formation 13. A least linear distance between the upper cross-bar portions and the lower cross-bar portions is equal to an upper and lower cross-bar linkage length of each cross-bar linkage, and the upper and lower cross-bar linkage length is equal to a cross-bar portion length of each cross-bar portion.

It is further contemplated that the device-retainer formation is central to the practice of the present invention and may thus be said to stand alone in terms of inventiveness. The device-retainer formation is basically designed to retain a cuboidal device, and as described hereinabove, preferably formed from a resilient unibody material construction, and configured to define a relaxed, truncated cuboidal interior volume when in a relaxed configuration. The device-retainer formation is actuable to define an actuated, truncated cuboidal interior volume, which actuated, truncated cuboidal interior volume receives a cuboidal device. Restorative forces of or inherent to the resilient unibody material construction are operable to retain a received cuboidal device within the actuated, truncated cuboidal interior volume. The device-retainer formation is preferably attachable to an interface mechanism as exemplified by an armband. The interface mechanism and the device-retainer formation together attach the cuboidal device to a support structure as exemplified by a user's arm.

Although the armband assembly and the device-retainer formation according to the present invention has been described by reference to certain different embodiments, aspects, and features, it is not intended that the novel assembly and formation be limited thereby, but that modifications thereof are intended to be included as falling within the broad scope and spirit of the foregoing disclosure, the appended drawings, and the following claims.

What is claimed is:

1. A universal armband assembly for retaining a mobile communications device in adjacency to a user's arm, the universal armband assembly comprising:

an armband, the armband comprising a band-to-retainer interface portion and a strap portion, the band-to-retainer interface portion comprising at least one strap-letting aperture and an outer interface portion end, the strap portion extending from the band-to-retainer interface portion in a direction opposite the outer interface portion end and comprising an outer strap portion end; and a device-retainer formation, the device-retainer formation being formed from a resilient unibody material construction and comprising an upper cross-bar linkage and a lower cross-bar linkage, the upper cross-bar linkage comprising an upper cross-bar linkage length, the lower cross-bar linkage comprising a lower cross-bar linkage length, the device-retainer formation being attached to the band-to-retainer interface portion and being configured to define a relaxed, truncated cuboidal interior volume, the device-retainer formation being actuable to define an actuated, truncated cuboidal interior volume, the actuated, truncated cuboidal interior volume for receiving a cuboidal mobile communications device, restorative forces of the resilient unibody material construction for retaining a received cuboidal mobile communications device within the actuated, truncated cuboidal interior volume;

the device-retainer formation comprises a series of corner-retention harnesses, the series of corner-retention harnesses comprising a pair of upper corner-retention harnesses and a pair of lower corner-retention harnesses, the pair of upper corner-retention harnesses extending opposite the pair of lower corner-retention harnesses relative to a transverse plane, the pairs of upper and lower corner-retention harnesses being respectively actuable away from the transverse plane for receiving the cuboidal mobile communications device lengthwise therebetween;

each corner-retention harness comprising opposed U-shaped portions and a cross-bar portion, the U-shaped portions extending in first and second dimensions, the cross-bar portion extending in a third dimension orthogonal to the first and second dimensions when the device-retainer formation is in a relaxed configuration defining the relaxed, truncated cuboidal interior volume;

the upper cross-bar linkage interconnecting the cross-bar portions of the pair of upper corner-retention harnesses, the lower cross-bar linkage interconnecting the cross-bar portions of the pair of lower corner-retention harnesses, the cross-bar portions extending obliquely relative to the upper and lower cross-bar linkages and the transverse plane;

the armband being configured to encircle the user's arm for retaining the device-retainer formation in adjacency to the user's arm, the device-retainer formation for retaining the received cuboidal mobile communications device in adjacency to the armband, the universal armband assembly thus for retaining the cuboidal mobile communications device in adjacency to the user's arm.

2. The universal armband assembly of claim 1 wherein the U-shaped portions of the series of corner-retention harnesses render the device-retainer formation octagonal in plan view thereby providing a series of corner-receiving truncations, the corner-receiving truncations for receiving a series of corners of the cuboidal mobile communications device.

3. The universal armband assembly of claim 2 wherein the device-retainer formation is regularly octagonal, the upper and lower cross-bar linkage lengths each being equal to a cross-bar portion length of each cross-bar portion.

4. The universal armband assembly of claim 1 wherein the upper and lower cross-bar linkages are displaced to a posterior position relative to the cuboidal mobile communications device when the device-retainer formation is actuated into an actuated configuration thereby providing upper and lower cross-bar linkage posterior displacements, the upper and lower cross-bar linkage displacements for enhancing stability of the cuboidal mobile communications device as retained within the actuated, truncated cuboidal interior volume.

5. An armband assembly for retaining an electronic device in adjacency to a user's arm, the armband assembly comprising:

an armband, the armband comprising a band-to-retainer interface portion and a strap portion, the band-to-retainer interface portion comprising an outer interface portion end, the strap portion extending from the band-to-retainer interface portion in a direction opposite the outer interface portion end; and a device-retainer formation, the device-retainer formation being formed from a resilient unibody material construction and comprising an upper cross-bar linkage and a lower cross-bar linkage, the upper cross-bar linkage comprising an upper cross-bar linkage length, the lower cross-bar linkage comprising a lower cross-bar linkage length, the device-retainer formation being attached to the band-to-retainer interface portion, the device-retainer formation being configured to define a relaxed, interior volume and being actuable to define an actuated, interior volume, the actuated, interior volume for receiving the electronic device, restorative forces of the resilient unibody material construction for retaining the electronic device within the actuated, interior volume;

the device-retainer formation comprises a series of corner-retention harnesses, the series of corner-retention harnesses comprising a pair of upper corner-retention harnesses and a pair of lower corner-retention harnesses, the pair of upper corner-retention harnesses extending opposite the pair of lower corner-retention harnesses relative to a transverse plane, the pairs of upper and lower corner-retention harnesses being actuable away from the transverse plane for receiving the electronic device lengthwise therebetween;

each corner-retention harness comprises opposed U-shaped portions and a cross-bar portion, the U-shaped portions extending in first and second dimensions, the cross-bar portion extending in a third dimension orthogonal to the first and second dimensions when the device-retainer formation is in a relaxed configuration defining the relaxed, interior volume;

the upper cross-bar linkage interconnecting the cross-bar portions of the pair of upper corner-retention harnesses, the lower cross-bar linkage interconnecting the cross-bar portions of the pair of lower corner-retention harnesses, the cross-bar portions extending obliquely relative to the upper and lower cross-bar linkages and the transverse plane;

the armband being configured to encircle the user's arm for retaining the device-retainer formation in adjacency to the user's arm, the device-retainer formation for retaining the electronic device in adjacency to the armband, the armband assembly thus for retaining the electronic device in adjacency to the user's arm.

6. The armband assembly of claim 5 wherein the U-shaped portions of the series of corner-retention harnesses render the device-retainer formation octagonal in plan view thereby providing a series of corner-receiving truncations, the corner-receiving truncations for receiving a series of corners of the electronic device.

7. The armband assembly of claim 6 wherein the device-retainer formation is regularly octagonal, the upper and lower cross-bar linkage lengths each being equal to a cross-bar portion length of each cross-bar portion.

8. The armband assembly of claim 5 wherein the upper and lower cross-bar linkages are displaced to a posterior position relative to the electronic device when the device-retainer formation is actuated into an actuated configuration thereby providing upper and lower cross-bar linkage posterior displacements, the upper and lower cross-bar linkage displacements for enhancing stability of the electronic device as retained within the actuated, interior volume.

9. A device-retainer formation for retaining a cuboidal device, the device-retainer formation being formed from a resilient unibody material construction and configured to define a relaxed, truncated cuboidal interior volume, the device-retainer formation being actuable to define an actuated, truncated cuboidal interior volume, the actuated, truncated cuboidal interior volume for receiving the cuboidal device, restorative forces of the resilient unibody material construction for retaining the cuboidal device as received within the actuated, truncated cuboidal interior volume;

the device-retainer formation comprising an upper cross-bar linkage, a lower cross-bar linkage, and a series of corner-retention harnesses, the series of corner-retention harnesses comprising a pair of upper corner-retention harnesses and a pair of lower corner-retention harnesses, the pair of upper corner-retention harnesses extending opposite the pair of lower corner-retention harnesses relative to a transverse plane, the pairs of upper and lower corner-retention harnesses being actuable away from the transverse plane for receiving the cuboidal device therebetween;

each corner-retention harness comprising opposed U-shaped portions and a cross-bar portion, the U-shaped portions extending in first and second dimensions, the cross-bar portion extending in a third dimension orthogonal to the first and second dimensions when the device-retainer formation is in a relaxed configuration defining the relaxed, truncated cuboidal interior volume;

the upper cross-bar linkage interconnecting the cross-bar portions of the pair of upper corner-retention harnesses, the lower cross-bar linkage interconnecting the cross-bar portions of the pair of lower corner-retention harnesses, the cross-bar portions extending obliquely relative to the upper and lower cross-bar linkages and the transverse plane.

10. The device-retainer formation of claim 9 wherein the U-shaped portions of the series of corner-retention harnesses render the device-retainer formation octagonal in plan view thereby providing a series of corner-receiving truncations, the corner-receiving truncations for receiving a series of corners of the cuboidal device.

11. The device-retainer formation of claim 9 wherein the upper and lower cross-bar linkages are displaced to a posterior position relative to the cuboidal device when the device-retainer formation is actuated into an actuated configuration thereby providing upper and lower cross-bar linkage posterior displacements, the upper and lower cross-bar linkage displacements for enhancing stability of the cuboidal device as retained within the actuated, truncated cuboidal interior volume.

* * * * *